US005279934A

United States Patent [19]

Smith et al.

[11] Patent Number: 5,279,934

[45] Date of Patent: Jan. 18, 1994

[54] PHOTOGRAPHIC LIGHT-SENSITIVE ELEMENTS

[75] Inventors: Dennis E. Smith; John L. Muehlbauer, both of Rochester, N.Y.

[73] Assignee: Eastman Kodak Company, Rochester, N.Y.

[21] Appl. No.: 74,259

[22] Filed: Jun. 9, 1993

[51] Int. Cl.[5] ..... G03C 1/76

[52] U.S. Cl. ..... 430/539; 430/523; 430/495; 430/950

[58] Field of Search ..... 430/271, 523, 539, 950, 430/961, 495

[56] References Cited

U.S. PATENT DOCUMENTS 4,920,004 4/1990 Bagchi ..... 430/950

5,026,632 6/1991 Bagchi et al. ..... 430/950

*Primary Examiner*—Jack P. Brammer

*Attorney, Agent, or Firm*—Robert A. Gerlach

[57] ABSTRACT

Photographic elements having at least one light-sensitive layer and at least one layer having polymeric matte particles surrounded by a layer of colloidal organic particles.

22 Claims, No Drawings

PHOTOGRAPHIC LIGHT-SENSITIVE ELEMENTS

BACKGROUND OF THE INVENTION

FIELD OF THE INVENTION

This invention relates to silver halide photographic light-sensitive elements and more particularly to a method of forming images wherein the silver halide photographic light-sensitive element contains a matting agent.

Finely divided materials with a mean particle size of from about 1 to about 10 micrometers are commonly used as matting agents to provide a rough surface to photographic elements. See, for example, U.S. Pat. Nos. 4,855,219 and 4,022,622. Further, U.S. Pat. Nos. 4,396,706 and 5,057,407 provide matte particles and techniques in order to increase the adhesion of the particles to the photographic element during processing of the element. In addition to the problems expressed in the previously recited references, printer dusting is also an objectionable problem associated with inadequate matte adhesion.

SUMMARY OF THE INVENTION

The invention contemplates a photographic element having at least one light-sensitive layer on a support, the light-sensitive element containing a layer containing polymeric matte particles having a polymeric core surrounded by a layer of polymeric latex colloidal particles reactive with or having an affinity with gelatin. The matte particles or beads in accordance with this invention can be included in any layer of the photographic element, but preferably are included in the outermost surface of a light-sensitive silver halide photographic element, in a separate layer over the top surface of the photographic element (surface protecting layer) or in a layer in close proximity to the outermost layer so that the matte particles protrude above the surface of the outermost layer. The matte particles are included in a layer containing gelatin. The polymeric matte particles have a mean diameter ranging from about 0.5 to about 10 micrometers and preferably from about 1 to about 5 micrometers and most preferably from about 1 to about 3.5 micrometers.

Photographic elements in accordance with this invention demonstrate improved processing characteristics in modern rapid development apparatus with respect to matte adhesion, printer dusting, lack of haze and improved back side abrasion because of the affinity of the matte particle for gelatin due to the presence of polymeric latex on the surface.

DETAILED DESCRIPTION OF THE INVENTION

As previously indicated, the matte particles in accordance with this invention include a polymeric core material surrounded by a layer of colloidal polymeric latex particles reactive with or having an affinity for gelatin. Any suitable colloidal polymer latex particles that are reactive with or have an affinity for gelatin can be used to form the particulate layer on the polymeric core. By polymer latex is meant particles prepared by an aqueous emulsion polymerization process. In emulsion polymerization processes the monomer or monomers necessary to form the desired homopolymer or copolymer, together with minor amounts of ingredients such as polymerization initiators, surfactants or emulsifying agents are added to water. In addition to the monomers, a typical polymerization mixture can include, for example, about 35 to about 97% by weight of water. The amount of water, to some extent, determines the size of the polymer particles, less water tends to result in larger particles. A water-soluble free radical initiator, typically about 0.1 to about 10% by weight, (based on the total monomer weight), and preferably from about 0.1 to about 5%, is used to initiate the polymerization. Examples of suitable initiators include redox systems comprising persulfates such as potassium persulfate or ammonium persulfate and a bisulfite such as sodium bisulfite or potassium bisulfite. Free radical initiators, e.g., azo compounds such as 4,4'-azobis(4-cyanovaleric acid), 2,2'-azobis(2-amidinopropane)hydrochloride or 2,2'-azobis(2-methylpropanesulfonate) can be used. The polymerization mixture also typically contains a surface active agent such as sodium dodecyl sulfate, octylphenoxypolyethoxyethanol, sodium lauryl sulfate, sodium stearate, and similar materials. Such surface active agents disperse the polymerizable monomers in the aqueous medium and concentrations are normally in the range of about 0.01 to about 0.5 parts by weight, based on the polymerization mixture.

In a typical emulsion polymerization process, the water is degassed with an inert gas such as argon or nitrogen, to remove oxygen, and the surfactant and a monomer or mixture of the monomers is added to the water. The initiator is added and the mixture is heated to about 80° to 90° C. for about 1 to 3 hours. The polymerization is complete when the monomer concentration, which can be monitored, diminishes to nearly zero. Optionally, the pH can be adjusted to about 7 to facilitate removal of the surfactant and the polymer particles stirred with a mixed bed ion exchange resin to remove surfactant.

The resulting copolymers typically have average diameters (swollen, in water) in the range of about 0.01 to about 1.0 micrometer, often about 0.01 to about 0.15 micrometer. The polymers are solid colloidal materials that are insoluble but dispersible in water and function as excellent stabilizers for the process for preparing the matte bead particles in accordance with this invention. It is convenient to use them in such processes in the form of aqueous latexes.

The colloidal polymer latex particles useful in the present invention include latex polymers that are reactive with or have an affinity for gelatin, preferably those capable of covalently bonding with gelatin, either directly or with the aid of a cross-linking agent.

Monomers, the polymers or copolymers of which are reactive with or have an affininty for gelatin, include monomers with an active halogen atom such as vinylchloroacetate, vinyl halogenated aromatics (e.g., chloro-methylstyrene), chloroalkyl acrylic or methacrylic esters (e.g., chloroethylmethacrylate, 3-chloro-2-hydroxypropylmethacrylate, or chloroethylacrylate), isocyanates (e.g., isocyanatoethyl acrylate, isocyanatoethyl methacrylate, or α, α-dimethylmetaisopropenylbenzyl isocyanate), epoxides (e.g., glycidyl acrylate or glycidyl methacrylate), and compounds containing aldehyde groups (e.g., vinyl benzaldehyde and acrolein), and monomers containing chloroethylsulfone groups or vinyl sulfone groups (e.g., chloroethylsulfonlymethylstyrene and vinlysulfonylmethylstyrene), as described in U.S. Pat. No. 4,161,407 issued to Campbell. Monomers, the polymers and copolymers of which are capable of covalently bonding with gelatin through the use of a cross-linking agent, include carboxylic acids (e.g., acrylic acid, methacrylic acid, itaconic acid, and maleic acid or anhydride), amine-containing monomers (e.g., 2-aminoethyl methacrylate and N-(3-aminopropyl) methacrylamide hydrochloride), and active methylene group-containing monomers (e.g., 2-acetoacetoxyethyl methacrylate and diacetone acrylamide). Monomers having functional groups capable of forming a covalent bond by reacting with an organic hardener or a binder such as gelatin as disclosed in U.S. Pat. No. 5,057,407 (incorporated herein by reference) can also be used.

Polymers useful in the invention as colloidal latex particles preferably comprise at least 0.1 mole percent or more preferably at least 1 mole percent of monomers, the polymers or copolymers of which are reactive with or have an affinity for gelatin, either directly or with the aid of a cross-linking agent and are represented by the formula:

$$-A_x(-B-)_{100-x}$$

wherein A represents recurring units derived from one or more of the monomers described above, and B represents recurring units derived from one or more other ethylenically unsaturated monomers.

Monomers represented by B include essentially any monomer capable of copolymerizing with the abovedescribed monomers without groups reactive with or having an affinity for or covalently bonding with gelatin. Examples of such monomers include ethylenically unsaturated monomers such as styrene and styrene derivatives (e.g., vinyltoluene, vinylbenzene, divinylbenzene, 4-t-butylstyrene), and acrylic and methacrylic acid esters (e.g., methyl methacrylate, methyl acrylate, ethyl methacrylate, n-butyl acrylate, 2-ethylhexyl methacrylate, 2-hydroxyethyl methacrylate, 2-hydroxyethyl acrylate, ethylene dimethacrylate, methacrylamide, and acrylonitrile). In such a copolymer, the amount of copolymers that are capable of covalently bonding with gelatin should be sufficient to bind the gelatin to the surface of the polymer particle.

In the above formula, x represents from 0.1 to 100 mole percent and preferably from 1 to 20 mole percent.

Any suitable polymeric core material or mixture of polymeric materials capable of being formed into particles having the desired size may be employed in the practice of this invention to prepare matte particles for use in photographic elements, such as, for example, olefin homopolymers and copolymers, such as polyethylene, polypropylene, polyisobutylene, polyisopentylene and the like; polyfluoroolefins such as polytetrafluoroethylene, polyvinylidene fluoride and the like, polyamides, such as, polyhexamethylene adipamide, polyhexamethylene sebacamide and polycaprolactam and the like; acrylic resins, such as polymethylmethacrylate, polyacrylonitrile, polymethylacrylate, polyethylmethacrylate and styrene-methylmethacrylate or ethylene-methyl acrylate copolymers, ethylene-ethyl acrylate copolymers, ethylene-ethyl methacrylate copolymers, polystyrene, polyvinyltoluene and copolymers of any of the unsaturated monomers mentioned above, cellulose derivatives, such as cellulose acetate, cellulose acetate butyrate, cellulose propionate, cellulose acetate propionate, and ethyl cellulose; polyvinyl resins such as polyvinyl chloride, copolymers of vinyl chloride and vinyl acetate and polyvinyl butyral, polyvinyl alcohol, polyvinyl acetal, ethylene-vinyl acetate copolymers ethylene-vinyl alcohol copolymers, and ethylene-allyl copolymers such as ethylene-allyl alcohol copolymers, ethylene-allyl acetone copolymers, ethylene-allyl benzene copolymers ethylene-allyl ether copolymers, ethylene-acrylic copolymers and polyoxy-methylene, polycondensation polymers, such as, polyesters, including polyethylene terephthalate, polybutylene terephthalate, polyurethanes and polycarbonates. In some applications for photographic elements it is desirable to select a polymer or copolymer that has an index of refraction that substantially matches the index of refraction of the material of the layer in which it is coated.

As indicated above, the most preferred mean particle size of the polymeric particles is from about 1 to about 3.5 micrometers. The mean diameter is defined as the mean of the volume distribution.

Any suitable method of preparing polymeric particles surrounded by a layer of colloidal polymeric latex particles may be used to prepare the matte bead particles for use in accordance with this invention. For example, suitably sized polymeric particles may be passed through a fluidized bed or heated moving or rotating fluidized bed of colloidal polymeric latex particles, the temperature of the bed being such to soften the surface of the polymeric core particles thereby causing the colloidal latex particles to adhere to the polymer particle surface. Another technique suitable for preparing polymer particles surrounded by a layer of colloidal polymeric latex particles is to spray dry the core particles from a solution of the polymeric material in a suitable solvent and then before the polymer particles solidify completely, passing the particles through a zone of colloidal polymeric latex particles wherein the coating of the particles with a layer of the colloidal latex particles takes place. Another method to coat the polymer particles is by Mechano Fusion.

A still further method of preparing the matte particles in accordance with this invention is by limited coalescence. This method includes the "suspension polymerization" technique and the "polymer suspension" technique. In the "suspension polymerization" technique, a polymerizable monomer or monomers is added to an aqueous medium containing a particulate suspension of colloidal polymeric latex particles to form a discontinuous (oil droplets) phase in a continuous (water) phase. The mixture is subjected to shearing forces by agitation, homogenization and the like to reduce the size of the droplets. After shearing is stopped an equilibrium is reached with respect to the size of the droplets as a result of the stabilizing action of the colloidal latex particles in coating the surface of the droplets and then polymerization is completed to form an aqueous suspension of polymer particles in an aqueous phase having a uniform layer thereon of colloidal polymer latex.

In the "polymer suspension" technique, a suitable polymer is dissolved in a solvent and this solution is dispersed as indicated above as fine water-immiscible liquid droplets in an aqueous solution that contains colloidal polymer latex particles as a stabilizer. Equilibrium is reached and the size of the droplets is stabilized by the action of the colloidal latex particles coating the surface of the droplets. The solvent is removed from the droplets by evaporation or other suitable technique resulting in polymeric particles having a uniform coating thereon of colloidal latex particles. The limited coalescence process is further described in U.S. Pat. No. 4,965,161 and in U.S. Pat. application Ser. No. 07/977,224 filed Nov. 16, 1992 assigned to the same assignee as this application, which are herein incorporated by reference.

In practicing this invention, using the suspension polymerization technique, any of the monomer or monomers capable of polyaddition, mentioned above, may be employed in the preparation of the core material.

In the suspension polymerization technique, other addenda are added to the monomer droplets and to the aqueous phase of the mass in order to bring about the desired result including initiators, promoters and the like which are more particularly disclosed in U.S. Pat. Nos. 2,932,629 and 4,148,741, both of which are incorporated herein in their entirety.

Useful solvents for the polymer suspension process are those that dissolve the polymer, which are immiscible with water and which are readily removed from the polymer droplets such as, for example, chloromethane, dichloromethane, ethylacetate, vinyl chloride, methyl ethyl ketone, trichloromethane, carbon tetrachloride, ethylene chloride, trichloroethane, toluene, xylene, cyclohexanone, 2-nitropropane and the like. Particularly useful solvents are dichloromethane and ethyl acetate because they are good solvents for many polymers while at the same time being substantially immiscible with water. Further, the volatility of these solvents is such that they can be readily removed from the discontinuous phase droplets by evaporation.

The quantities of the various ingredients and their relationship to each other in the polymer suspension process can vary over wide ranges, however, it has generally been found that the ratio of the polymer to the solvent should vary in an amount of from about 1 to about 80% by weight of the combined weight of the polymer and the solvent and that the combined weight of the polymer and the solvent should vary with respect to the quantity of water employed in an amount of from about 5 to 65% by weight and preferably from about 25 to about 50% by weight. The size and quantity of the colloidal polymer latex particles depends upon the size of the polymer droplet particles desired. Thus, as the size of the polymer/solvent droplets are made smaller by high shear agitation, the quantity of colloidal polymer latex particles is varied to prevent uncontrolled coalescence of the droplets and to achieve uniform size and narrow size distribution of the polymer particles that result. The suspension polymerization technique and the polymer suspension technique herein described are the preferred methods of preparing the matte particles for use in the preparation of light-sensitive photographic elements in accordance with this invention. These techniques provide particles having a predetermined average diameter anywhere within the range of from 0.5 micrometer to about 150 micrometers with a very narrow size distribution. The coefficient of variation (ratio of the standard deviation) to the average diameter, as described in U.S. Pat. No. 2,932,629, referenced previously herein, is normally in the range of about 15 to 35%.

When limited coalescence is used to prepare the matte particles, in accordance with this invention, the colloidal polymer latex particles, which are reactive with or have an affinity for gelatin also serve in the preparation of the matte particles as colloidal stabilizing agents. In the limited coalesence process, the hydrophilic hydrophobic balance is important since the stabilizer must collect within the aqueous medium at the interface with the suspended droplet. The proper balance can be achieved in a specific situation by appropriate selection of monomers and their amount in the copolymer stabilizer. If less oleophilic monomer is used the copolymer does not attach to the surface of the suspension droplet, and if more is used the copolymer can enter the droplet instead of staying on its surface. If less hydrophilic monomer is used the copolymer can enter the droplet and not remain on its surface, and if more is used the copolymer can stay in the water and not attach to the droplet. If less ionic monomer is used the droplets can coalesce to form an unstable suspension, and if more is used the copolymer can remain in the water and not attach to the surface of the droplets. If a copolymer which is soluble in the droplets is used, some crosslinking monomer is preferably added to prevent the copolymer from dissolving in the suspended droplet to form an unstable suspension. If too much crosslinking monomer is present, however, the copolymer cannot attach to the surface of the droplets to stabilize the suspension. Using the teachings of this specification in light of known prior art such as U.S. Pat. Nos. 2,932,629 and 4,148,741, referred to previously herein, one skilled in the art can readily determine the copolymer or class of copolymers having the hydrophilic-hydrophobic balance best suited for use as a colloidal stabilizer in a particular suspension process.

The monomers used in forming the colloidal latex stabilizers are addition polymerizable and include monomers containing ethylenic unsaturation or more specifically vinylic, acrylic and/or allylic groups. Examples of suitable nonionic oleophilic monomers include, n-pentyl acrylate, n-butyl acrylate, benzyl acrylate, t-butyl methacrylate, 1,1-dihydroperfluorobutyl acrylate, benzyl methacrylate, m- and p-chloromethylstyrene, butadiene, 2-chloroethyl methacrylate, ethyl methacrylate, isobutyl acrylate, 2-ethylhexyl acrylate, 2-ethylhexyl methacrylate, chloroprene, n-butyl methacrylate, isobutyl methacrylate, isopropyl methacrylate, lauryl acrylate, lauryl methacrylate, methyl acrylate, methyl methacrylate, 2-ethoxyethyl acrylate, 2-ethoxyethyl methacrylate, 2-cyanoethyl acrylate, phenyl acrylate, isopropyl acrylate, n-propyl methacrylate, n-hexyl acrylate, styrene, sec-butyl acrylate, p-t-butylstyrene, N-t-butylacrylamide, vinyl acetate, vinyl bromide, vinylidene bromide, vinyl chloride, m- and p-vinyltoluene, a-methylstyrene, methyl p-styrenesulfonate, potassium or sodium-o-styrene sulfonate, potassium or sodium p-styrene sulfonate, vinylbenzyl acetate and vinyl benzoate.

Examples of suitable nonionic hydrophilic monomers that are useful for making the copolymer stabilizers used in this invention include, for example, acrylamide, allyl alcohol, n-(isobutoxymethyl)acrylamide, N-(isobutoxymethyl)methacrylamide, m- and p-vinylbenzyl alcohol, cyanomethyl methacrylate, 2-poly(ethyleneoxy)ethyl acrylate, methacryloxyloxypolyglycerol, glyceryl methacrylate, 2-hydroxyethyl acrylate, 2-hydroxypropyl acrylate, n-isopropylacrylamide, 2-methyl-1-vinylimidazole, 1-vinylimidazole, methacrylamide, 2-hydroxyethyl methacrylate, methacryloylurea, acrylonitrile, methacrylonitrile, N-acryloylpiperidine, 2-hydroxypropyl methacrylate, N-vinyl-2-pyrrolidone, p-aminostyrene, N,N-dimethylmethacrylamide, N-methyacrylamide, 2-methyl-5-vinylpyridine, 2-vinylpyridine, 4-vinylpyridine, N-isopropylmethacrylamide, N,N-dimethylacrylamide, 2-(diethylamino)ethyl acrylate, 2-(dimethylamino)ethyl acrylate, 2-(dimethylamino)ethyl methacrylate, and 2-(diethylamino)ethyl methacrylate. Such hydrophilic monomoners are well known in the art and are generally considered to be monomers that can be mixed in an excess of water, e.g., a minimum of 2 grams of monomer in 100 grams of water, at 25° C. to form homogenous solutions or dispersions in the absence of a stabilizing agent. Such a solution or dispersion has a substantially uniform composition throughout. In contrast, the oleophilic monomers previously described herein fail to meet these criteria.

Suitable ionic monomers that can be used in the copolymer stabilizers include both anionic and cationic monomers that dissociates in water at the pH at which the copolymer is prepared. Examples of such anionic monomers are aconitic acid, acrylic acid, methacrylic acid, fumaric acid, itaconic acid, maleic acid, 2-methacryloyloxyethylsulfuric acid, sodium salt, pyridinium 2-methacryloyloxyethylsulfate, 3-acrylamidopropane sodium salt, 3-methacryloxyloxypropane-1-sulfonic acid, sodium salt, 2-acrylamido-2-methylpropanesulfonic acid, methacrylic acid, sodium salt, lithium methacrylate, 2-methacryloyloxyethyl 1-sulfonic acid ammonium p-styrenesulfonate, and sodium o- and p-styrenesulfonate. Examples of suitable cationic monomers include, for example, N-(3-acrylamidopropyl)ammonium methacrylate N-(2-methacryloyloxyethyl)-N,N,N,-trimethylammonium iodide, N(2-methacryloyloxyethyl)-N,N,N,-trimethylammonium p-toluenesulfonate, 1,2-dimethy-5-vinylpyridinium methosulfate, N-(2-methacryloyloxyethyl)-N,N,N-trimethylammonium bromide, N-(2-methacryloyloxyethyl)-N,N,N-trimethylammonium fluoride, N-vinylbenzyl-N,N,N-trimethylammonium chloride, 3-methyl-1-vinylimidazolium methosulfate, N-(3-methacrylamidopropyl)-N-benzyl-N,N-dimethylammonium chloride, and N-(3-methacrylamidopropyl) N,N,N-trimethylammonium chloride.

Suitable crosslinking monomers useful for making the copolymer stabilizers used in this invention include, for example, N,N'-methylenebisacrylamide, ethylene glycol dimethacrylate, 2,2-dimethyl-1,3-propylene diacrylate, divinylbenzene, N,N'-bis(methacryloyl)urea, 4,4'-isoproylidenediphenylene diacrylate, 1,3-butylene diacrylate, 1,4-cyclohexylenedimethylene dimethacrylate, ethylene diacrylate, ethylidene diacrylate, 1,6-diacrylamidohexane, 1,6-hexamethylene diacrylate, 1,6-hexamethylene diemthacrylate, tetramethylene dimethacrylate, ethylenebis(oxyethylene)diacrylate, ethylenebis(oxyethylene)dimethacrylate, ethylidyne trimethacrylate and 2-crotonoyloxyethyl methacrylate.

the colloidal latex stabilizers described in U.S. Pat. No. 4,965,131, incorporated herein by reference, are suitable for use in accordance with this invention so long as they contain a group reactive with or have an affinity for gelatin in accordance with the teaching previously set forth herein.

The matte particles, comprising the polymer core surrounded by the colloidal polymeric latex particles are bonded with gelatin simply by contacting the particles with gelatin under conditions as described below. If the latex polymer is of the type that utilizes a cross-linking agent to bond with gelatin, the latex polymer particles are preferably first contacted with the cross-linking agent and then with gelatin, so the gelatin preferentially reacts with the latex polymer particles, instead of gelatin-gelatin cross-linking. Carbamoyl pyridinium cross-linking agents are advantageously utilized in the practice of this invention because they tend to first bond to a carboxyl group on a polymer particle and then with an amino group on the gelatin molecule. Contacting the matte particles and gelatin is preferably performed in an aqueous dispersion of the particles. The concentration of matte particles in the aqueous dispersion is preferably less than about 25% and more preferably less than about 15% by weight. The concentration of gelatin in the aqueous dispersion is preferably less than about 25% and more preferably less than about 15% by weight. The matte particles should be present to achieve a coverage of from about 2 to about 500 mg per square meter when applied to a photographic element.

The pH of the aqueous dispersion and the concentration of the particles and gelatin should be adjusted to prevent bridging of gelatin molecules between matte particles. The pH of the gelatin is preferably maintained above the isoelectric pH of the gelatin (e.g., above 5.8 and preferably between 8 and 10 for lime-processed bone gelatin). Under such conditions, both the particles and the gelatin should have the same charge, preferably negative, in order to minimize coagulation.

The matte particles made in accordance with this invention strongly adhere to the film thus eliminating the problems of processing solutions scumming and printer dusting.

In this invention, the matting agent is generally incorporated into the outermost layer of a light sensitive material, however, as indicated above, the matting agent can be incorporated into any layer of the light sensitive element. By outermost layer is meant either the emulsion side surface protecting layer or a backing layer or both. However, it is particularly preferable to incorporate the matting agent in the surface protecting layer.

The matting agent is employed in an amount to achieve a coverage of from about 2 to about 500 mg per square meter.

As for gelatin, any kind of gelatin, for example, alkali-processed gelatin, acid-processed gelatin, enzyme-processed gelatin, gelatin derivatives and denatured gelatins, are usable.

Further, the outermost layer of this invention may optionally contain a hardening agent, a smoothing agent, a surface active agent, an antistatic agent, a thickener, polymers, an ultraviolet ray absorbent, a high boiling point solvent, silver halides, a formalin capturing agent, a polymer latex and various other additives.

Examples of a hardening agent employable in this invention includes aldehyde series compounds, active halogen-containing compounds such as 2-hydroxy-4,6-dichloro-1,3,5-triazine, vinyl sulfone series compounds, N-methylol series compounds, halogencarboxyaldehyde compounds such as mucochloric acid, and so on.

As a surface active agent, any kind of surface active agents, for example, natural surface active agents such as saponin, nonionic surface active agents such as polyalkyleneoxide; cationic surface active agents such as higher alkylamines, quaternary ammonium salts and so on; anionic surface active agents containing acidic groups such as carboxylic acid, sulfonic acid and so forth may be employed.

As an antistatic agent, the outermost layer may contain surface active agents as described above, alkali metal salts of styrene-maleic acid series copolymers and acrylonitrile-acrylic acid series copolymers, and antistatic agents as described in U.S. Pat. Nos. 3,206,312; 3,428,451; metal oxides, such as $V_2O_5$, $SnO_2$, $ZnO_2$, $TiO_2$, antimony doped $SnO_2$ and the like. Suitable metal oxides are set forth in U.S. Pat. Nos. 4,203,769;

4,264,707; 4,275,103; 4,394,441; 4,495,276; 4,999,276 and so forth.

Photographic elements in which the particles of the invention can be utilized generally comprise at least one light-sensitive layer, such as a silver halide emulsion layer. This layer may be sensitized to a particular spectrum of radiation with, for example, a sensitizing dye, as is known in the art. Additional light-sensitive layers may be sensitized to other portions of the spectrum. The light sensitive layers may contain or have associated therewith dye-forming compounds or couplers. For example, a red-sensitive emulsion would generally have a cyan coupler associated therewith, a green-sensitive emulsion would be associated with a magenta coupler, and a blue-sensitive emulsion would be associated with a yellow coupler. Other layers and addenda, such as antistatic compositions, subbing layers, surfactants, filter dyes, protective layers, barrier layers, development inhibiting releasing compounds, and the like can be present in photographic elements of the invention, as is well-known in the art. Detailed description of photographic elements and their various layers and addenda can be found in the above-identified *Research Disclosure* 17643 and in James, *The Theory of the Photographic Process*, 4th, 1977.

Photographic elements suitable for use in combination with the overcoat layer containing matte particles in accordance with this invention are disclosed in *Research Disclosure* 22534, January 1983, which is incorporated herein by reference. Further, the light sensitive elements disclosed in U.S. Pat. No. 4,980,267, fully incorporated herein by reference, are particularly applicable to protection by the overcoat layers in accordance with this invention.

It is, at times, desirable to include in the layer containing the matte particles in accordance with this invention, an amount of polymeric emulsion polymerized latex particles independently of the matte particles to improve adhesion during processing. Suitable polymeric latex particles have a diameter of from about 0.01 to 0.5 μm, preferably from about 0.02 to about 0.1 μm and are employed in an amount of from about 10 to about 75 weight percent, preferably from about 25 to about 50 percent by weight based on the weight of the gelatin present in the layer. Suitable monomers for use in the preparation of latex homopolymers or copolymers include, for example, methyl acrylate, methyl methacrylate, 2-acrylamido-2-methyl propane sulfonic acid, styrene, butyl methacrylate, 2-methacryloyloxyethyl-1-sulfonic acid-sodium salt, vinylidene chloride, itaconic acid, acrylonitrile, acrylic acid, n-butyl acrylate, 2-[N,N,N-trimethyl ammonium] ethyl methacrylate methosulfate and the like. Particularly, suitable copolymers include polymethyl acrylate-co-2-acrylamido-2-methylpropane sulfonic acid (96:4), styrene-co-butylmethacrylate-co-2 methacryloyloxy-ethyl-1-sulfonic acid-sodium salt, methyl acrylate-co-vinylidene chloride-co-itaconic acid, acrylonitrile-co-vinylidene chloride-co-acrylic acid, n-butyl acrylate-co methylmethacrylate, acrylonitrile-co-vinylidene chloride-co-2[N,N,N,-bimethyl ammonium] ethyl methacrylate methosulfate and the like.

It may also be desirable to add to the layer containing the matte particles in accordance with this invention, colloidal inorganic particles such as, colloidal silica, colloidal alumina, colloidal alumina-silica and the like in an amount up to about 50% by weight based on the weight of the gelatin. Preferably an amount of from 5–40% by weight should be used. A preferred material is Ludox AM sold by DuPont Co.

It is also, at times, desirable to employ as the polymer for the polymer core of the matte particles one that has a refractive index that closely matches that of the binder for the layer containing the particles. A copolymer of vinyl toluene and methyl methacrylate can be made which provides an index of refraction substantially identical to the gelatin binder layer. The exact amount of each monomer is dependent upon the precise index of refraction of the binder layer with all its components.

The invention is further illustrated by the following examples:

Preparation of Polymeric Latex Colloidal Particles

Example 1

To 73.6 kg of deoxygenated, distilled water is added 165.6 g sodium dodecyl sulfate (SDS). Into a separate container is weighed 176.6 g styrene, 1104 g butyl methacrylate, 662.4 g 2-hydroxyethyl methacrylate, 110.4 g methacrylic acid and 154.6 g ethylene glycol dimethacrylate. These materials are deoxygenated by bubbling nitrogen beneath the surface for one-half hour. The aqueous phase is heated to 85° C. and monomer mix is added with stirring. Immediately 9.57 g ammonium persulfate is added. The mixture is cooled to room temperature after 3 hours.

Example 2

To 73.6 kg of deoxygenated, distilled water is added 165.6 g sodium dodecyl sulfate (SDS). Into a separate container is weighed 630 g styrene, 839 g butyl methacrylate, 662.4 g 2-hydroxyethyl methacrylate, 110.4 g methacrylic acid and 66.2 g ethylene glycol dimethacrylate. These materials are deoxygenated as to Example 1. The aqueous phase is heated to 85° C. and monomer mix is added with stirring. Immediately 9.57 g ammonium persulfate is added. The mixture is cooled to room temperature after 3 hours.

Example 3 Preparation of Matte Particles 14.4 g of Vazo 52, an initiator sold by DuPont Co., is dissolved in 736 g of vinyltoluene. In a separate container is placed 3720 g of pH-10 buffer sold by VWR Scientific and 375 g of polymeric latex made per Example 1. The organic phase is then added to the aqueous phase and stirred. Droplets are formed by passing through a homogenizer and the polymerization is conducted at 50° C. with 100 RPM stirring overnight. The mean particle size is 3.3 microns.

Example 3A Preparation of Gel Grafted Matte Particles 1500 grams of the particles prepared in Example 3 at 11.7% solids in pH 10 buffer are placed in a flask and the pH is adjusted to 8.0 using 1% HCl. The flask is heated to 60° C. and 7.88 grams of 1-(4-morpholinocarbonyl)-4-(2-sulfoethyl) pyridinium hydroxide, inner salt are added and stirred for 30 minutes at which time 900 grams of a 12.5% dionized gelatin solution at 60° C. and pH 8 are added and stirred for another 30 minutes at which time it is placed in a refrigerator.

Table I gives additional examples made by this procedure.

TABLE I

| Example No. | Latex (gms) | Buffer (gms) | Mean Size (μ) |
|---|---|---|---|
| 3 | 375 | 3720 | 3.3 |

TABLE I-continued

| Example No. | Latex (gms) | Buffer (gms) | Mean Size (μ) |
|---|---|---|---|
| 4 | 450 | 3720 | 1.6 |
| 5 | 50 | 4170 | 11.6 |

Example 6 Preparation of Matte Particles 120 g of poly(vinyl toluene) is dissolved in 480 g ethyl acetate. Into a separate container is weighed 1.8 kg of pH-10 buffer (VWR) and 290 g of the polymer latex made per Example 1. The organic phase is added to the aqueous phase and stirred for 30 minutes in a sealed container. A Gaulin Homogenizer operated at 3000 psi is used to form droplets. The ethyl acetate is evaporated overnight from a stirred container using a nitrogen sweep. The particles have a 7.5 micron mean volume.

Table II gives additional examples made by this procedure.

TABLE II

| Example No. | Latex Prep No. | Latex (gms) | Buffer (gms) | Polymer Type | Mean Size (Microns) |
|---|---|---|---|---|---|
| 6 | Ex. 1 | 290 | 1800 | PVT* | 7.5 |
| 7 | Ex. 1 | 350 | 1800 | PVT* | 7.0 |
| 8 | Ex. 2 | 3060 | 45000 | PSBA* | 4.1 |

*PVT = Poly(vinyltoluene); PSBA = Poly (styrene co-butyl acrylate)

Example 9 (Control)

12.5 g Aerosol OT-100 sold by American Cyanamide and 10 g of Vazo 64, sold by DuPont are added to 2 kg of vinyltoluene and stirred until dissolved. 6.37 kg of distilled water is then added and stirred for 15 minutes. The emulsion is formed using a Gaulin colloid mill set at 1 gal/min feed rate, 0.006" gap setting and 3500 RPM. The emulsion is fed into a 12 liter flask and heated to 70° C. while stirring at 100 RPM overnight with a Teflon blade paddle stirrer. This procedure yields particles having a mean diameter of 3.2 micrometers.

Example 10 (Adhesion Evaluation)

In a mixing vessel combine 1179 grams of Type IV gelatin, as a swollen gelatin which contains 65% water; 1000 grams distilled water; 285.3 grams of a matte dispersion, which consists of 6.75% matte beads (See Table III), 7.5% Type IV gelatin, and the balance distilled water; and 222 grams of a lubricant/gelatin dispersion which contains 9.0% Type IV gelatin.

Each mixture is heated at 46 degrees C. with gentle stirring until the gelatin dissolves completely, (approximately 30 minutes), and a uniform solution is achieved.

Each solution is held at 46 degrees C. and the following addenda are added in the following order:

| | |
|---|---|
| Sulfuric acid | 30 cc/pound gelatin |
| Alkanol XC | 13.6 cc/pound of gelatin |
| Surfactant 10G | 14.0 cc/pound of gelatin |
| Fluorad FC135 | 2.0 cc/pound gelatin. |

The solutions are then cooled to 40 degrees C.; the pH adjusted to 5.5 with either a weak acid or base as needed and distilled water added to bring the total weight of the solution to 4761 grams.

The coating compositions are coated onto a photographic support and processed under controlled conditions. A roller is then evaluated for visual appearance and rated on a 1 to 5 scale where 1 is best and 5 indicates considerable matte contamination. This contamination comes from matte which has been removed from the film surface during processing. Additionally, a piece of adhesive tape is used to remove the matte particles from the roller and the number of particles per 4.7 sq cm is counted.

Results are tabulated in Table III.

TABLE III

| Example No. | Polymer Type | Laydown (mg/ft$^2$) | Visual Appearance | Tape Count 300 × 4.7 cm$^2$ |
|---|---|---|---|---|
| 9 (Control) | Vt[a] | 3.5 | 4 | 371 |
| 9 (Control) | Vt | 17 | 5 | 319[b] |
| Ex. 3 | Vt | 17 | 1 | 71 |
| Ex. 3A | Vt/Gel | 17 | 1 | 88 |

[a]Vinyltoluene
[b]Only 1/10th the normal length of film processed.

This data clearly shows improved adhesion after processing when operating in accordance with this invention.

Example 11

A cellulose triacetate film support having an antihalation layer on one side and an antistatic layer on the other is coated on the antihalation layer with the following layers in sequence (coverages are in grams per meter squared):

Slow Cyan Dye-Forming Layer

This layer comprises a blend of red-sensitized, cubic, silver bromoiodide emulsion (1.5 mol percent iodide) (0.31 μm grain size) (1.16 g/m$^2$) and red-sensitized, tabular grain, silver bromoiodide emulsion (3 mol percent iodide) (0.75 μm diameter by 0.14 μm thick) (1.31), Compound J (0.965), Compound F (0.011), Compound L (0.65) and gelatin (2.96).

Fast Cyan Dye-Forming Layer

This layer comprises a red-sensitized, tabular grain silver bromoiodide emulsion (6 mol percent iodide) having a diameter of 1.40 μm and a thickness of 0.12 μm (0.807), Compound J (0.102), Compound K (0.065), Compound L (0.102) and gelatin (1.506).

Interlayer

This layer comprises Compound F (0.054), an antifoggant and gelatin (1.291).

Slow Magenta Dye-Forming Layer

This layer comprises a blend of green-sensitized tabular grain silver bromoiodide emulsion (3 mol percent iodide) (grain diameter 0.55 μm and thickness 0.08 μm) (0.473) and tabular grain silver bromoiodide emulsion (3 mol percent iodide) (grain diameter 0.52 and thickness 0.09 μm) (0.495), Compound G (0.161), Compound (0.108) and gelatin (2.916).

Fast Magenta Dye-Forming Layer

This layer comprises a blend of green-sensitized tabular grain silver bromoiodide emulsion (3 mol percent iodide) (grain diameter 1.05 μm and thickness 0.12 μm) (0.536) and tabular grain silver bromoiodide emulsion (3 mol percent iodide) (grain diameter 0.75 μm and thickness 0.14 μm), Compound G (0.258), Compound H (0.054) and gelatin (1.119).

Interlayer

This layer comprises Carey-Lea Silver (0.43), Compound F (0.054), an antifoggant and gelatin (0.861).

Slow Yellow Dye-Forming Layer

This layer comprises a blend of blue-sensitized tabular grain silver bromoiodide emulsions (3 mol percent iodide) (grain diameter 0.57 μm and thickness 0.12 μm) (0.274) and blue-sensitive silver bromoiodide emulsion (0.3 mol percent iodide) (grain diameter 0.52 μm and thickness 0.09 μm) (0.118), Compound C (1.022), Compound D (0.168) and gelatin (1.732).

Fast Yellow Dye-Forming Layer

This layer comprises a blue-sensitized tabular grain silver bromoiodide emulsion (3 mol percent iodide) (grain diameter 1.10 μm and thickness 0.12 μm) (0.43), Compound C (0.161), Compound D (0.054), Compound E (0.003) and gelatin (0.791).

UV Absorbing Layer

This layer comprises silver halide Lippmann emulsion (0.215), Compound A (0.108), Compound B (0.106) and gelatin (0.538).

Overcoat

This layer comprises matte particles of Example 3 (0.038) and gelatin (0.888)

The thus prepared photographic film is perforated in 35 mm format, exposed in a 35 mm camera and processed in a standard photofinishing processor. The processed film is printed in a standard photofinishing, high speed printer which has roller contact with the overcoat layer. The roller of the printer is removed and inspected for matte particles that dusted from the surface. The roller appears free of matte particles when viewed under an optical microscope.

The structures of the above-designated Compounds A through L are as follows:

A:

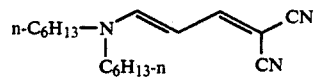

B:

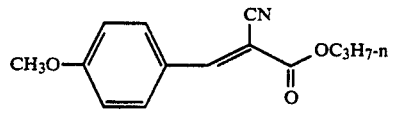

C:

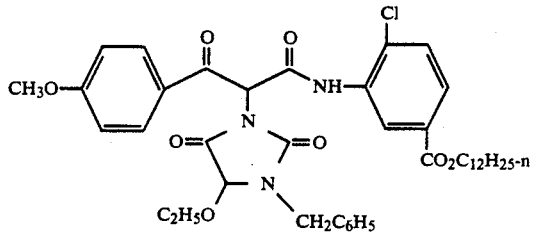

D:

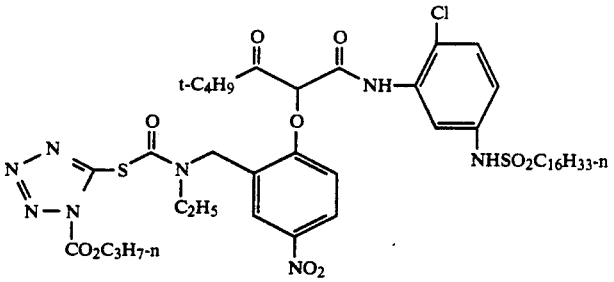

E:

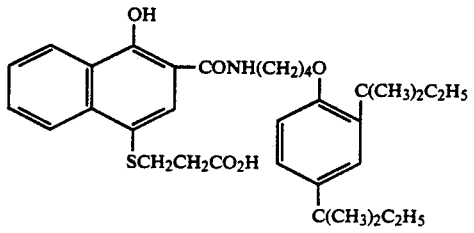

F:

-continued
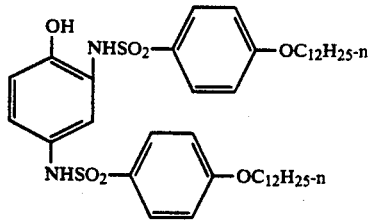
G:
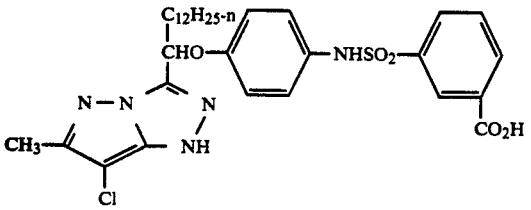
H:
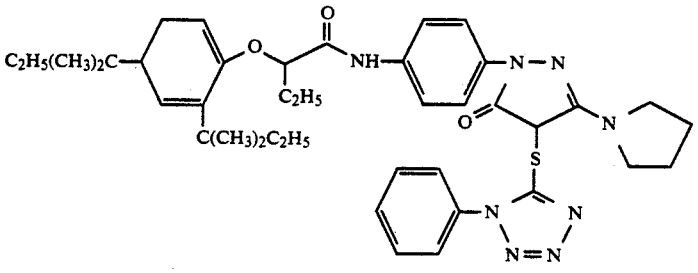
I:
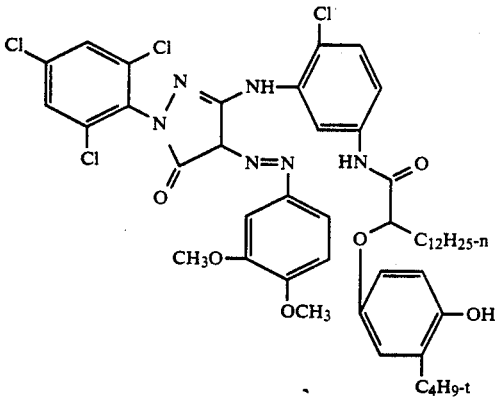
J:
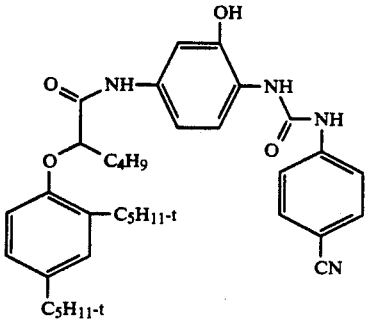
K:

-continued

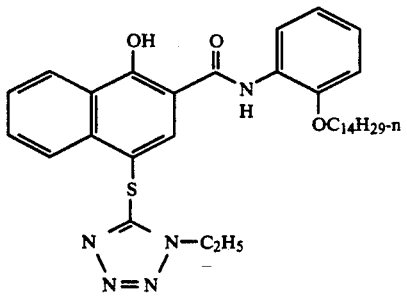

L:

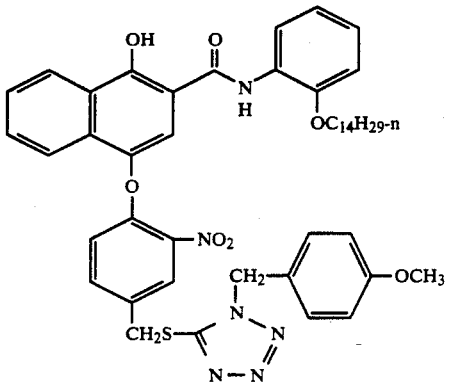

It is to be understood that other polymeric particles surrounded by a uniform layer of other colloidal polymeric latex particles may be used throughout the examples in place of the particles particularly employed therein to obtain comparable results.

What is claimed is:

1. A photographic element comprising at least one light-sensitive layer on a support said element containing at least one gelatin layer containing polymeric matte particles having a polymeric core surrounded by a layer of colloidal polymeric latex particles, the latex particles being reactive with or having an affinity for gelatin.

2. The photographic element of claim 1 wherein the polymeric matte particles have a mean particle diameter of from 0.5 to 10 micrometers.

3. The photographic element of claim 1 wherein the polymeric matte particles have a mean particle diameter of from 1 to 5 micrometers.

4. The photographic element of claim 1 wherein the polymeric matte particles have a mean particle diameter of from 1 to 3.5 micrometers.

5. The photographic element of claim 1 wherein the polymeric core is a polyaddition polymer.

6. The photographic element of claim 1 wherein the polymeric core is a polycondensation polymer.

7. The photographic element of claim 5 wherein the polyaddition polymer is polyvinyltoluene.

8. The photographic element of claim 1 wherein the polymeric matte particles are included in the outermost layer.

9. The photographic element of claim 1 wherein the polymeric matte particles are included in a surface protecting layer.

10. The photographic element of claim 1 wherein the colloidal polymeric latex particles covalently bond to gelatin.

11. The photographic element of claim 10 wherein the polymeric matte particles have a mean particle diameter of from 1 to 5 micrometers.

12. The photographic element of claim 10 wherein the polymeric matte particles have a mean particle diameter of from 1 to 3.5 micrometers.

13. The photographic element of claim 10 wherein the polymeric core is a polyaddition polymer.

14. The photographic element of claim 10 wherein the polymeric core is a polycondensation polymer.

15. The photographic element of claim 13 wherein the polyaddition polymer is polyvinyltoluene.

16. The photographic element of claim 10 wherein the polymeric matte particles are included in the outermost layer.

17. The photographic element of claim 10 wherein the polymeric matte particles are included in a surface protecting layer.

18. The photographic element of claim 1 wherein the polymeric matte particles are prepared by limited coalesence.

19. The photographic element of claim 1 wherein the polymeric core is a cellulose derivative.

20. The photographic element of claim 1 wherein the colloidal polymeric latex particles have an average diameter of from about 0.01 to 1 μm.

21. The photographic element of claim 1 wherein the colloidal polymeric latex particles have an average diameter of from about 0.01 to 0.15 μm.

22. The photographic element of claim 1 wherein the colloidal polymeric latex particles are crosslinked.

* * * * *